US008736512B2

(12) United States Patent
Grice et al.

(10) Patent No.: US 8,736,512 B2
(45) Date of Patent: May 27, 2014

(54) ITEM MOUNTING SYSTEM

(75) Inventors: Derek Grice, Accrington (GB); Ray Beagan, Accrington (GB); Jason Koch, Accrington (GB)

(73) Assignee: Raven Group Limited, Dunfermline (GB)

( * ) Notice: Subject to any disclaimer, the term of this patent is extended or adjusted under 35 U.S.C. 154(b) by 602 days.

(21) Appl. No.: 12/733,452

(22) PCT Filed: Dec. 22, 2008

(86) PCT No.: PCT/GB2008/004257

§ 371 (c)(1), (2), (4) Date: Mar. 2, 2010

(87) PCT Pub. No.: WO2009/081163

PCT Pub. Date: Jul. 2, 2009

(65) Prior Publication Data

US 2010/0309090 A1 Dec. 9, 2010

(30) Foreign Application Priority Data

Dec. 22, 2007 (GB) ..... 0725178.8

(51) Int. Cl.
*H01Q 3/02* (2006.01)

(52) U.S. Cl.
USPC ..... 343/882; 343/878; 343/892

(58) Field of Classification Search
CPC ..... H01Q 1/125; H01Q 1/1264; H01Q 3/08
USPC ..... 343/882, 915, 878, 892
See application file for complete search history.

(56) References Cited

U.S. PATENT DOCUMENTS

| | | | | |
|---|---|---|---|---|
| 2005/0264467 | A1 | 12/2005 | Lin et al. | H01Q 3/02 |
| 2006/0214865 | A1 * | 9/2006 | Bury | 343/765 |

FOREIGN PATENT DOCUMENTS

| | | | | |
|---|---|---|---|---|
| DE | 3530809 | A1 * | 3/1987 | |
| WO | 99/41802 | | 8/1999 | H01Q 1/12 |
| WO | 00/17955 | | 3/2000 | H01Q 1/12 |

* cited by examiner

*Primary Examiner* — Dieu H Duong
(74) *Attorney, Agent, or Firm* — Head, Johnson & Kachigian, P.C.

(57) ABSTRACT

The invention relates to apparatus and a method to allow the adjustment of a position of an item, such as an antenna of satellite broadcast receiving apparatus so as to allow the elevation and/or azimuth position to be fixed accurately. Adjustment means are provided which have an axis of rotation offset to the center axis of a body portion of the rotatable member to allow the body portion side walls to act as a cam.

13 Claims, 7 Drawing Sheets

ITEM MOUNTING SYSTEM

Figure 1A:
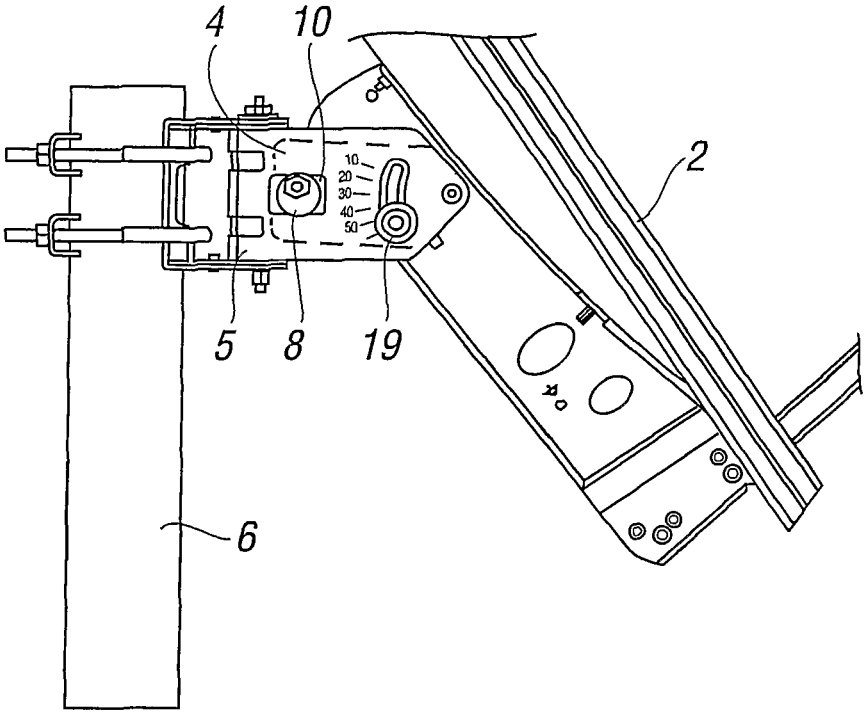
Figure 1B:
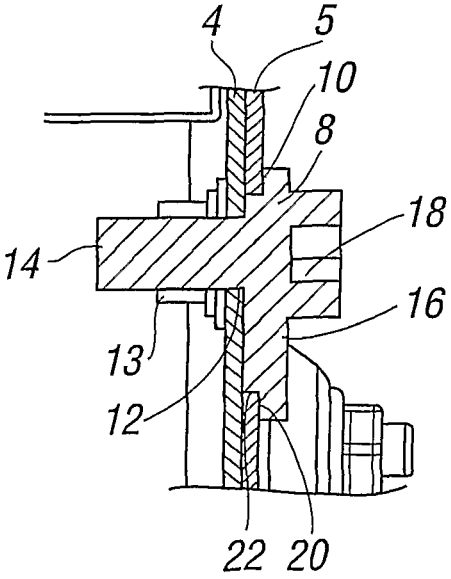

The invention to which this application relates is the provision of a mounting system, such as that used for mounting antenna apparatus which can be mounted for the reception of transmitted signals which are typically transmitted via at least one satellite from a broadcast location. The invention also relates to antenna apparatus incorporating the mounting system therewith.

The data which is transmitted is typically digital in nature and allows the generation of data television and/or radio programmes and/or auxiliary information once the broadcast signals have been received by the antenna and then processed via a Low Noise Block (LNB) and passed to a broadcast data decoder as video/audio and/or auxiliary data. Once the data has been received by the decoder, the audio and/or video is displayed to the user via a computer, television set or radio. The decoder apparatus is typically located within a premises and the antenna includes a dish shaped antenna which is mounted externally of the premises along with the LNB which is mounted there with a supporting mounting bracket. The antenna apparatus can also include a Block up converter.

The antenna is required to be securely fixed to the wall or a supporting structure via a mounting bracket which is provided to allow for the mechanical fixing of the antenna to the structure.

In addition to the secure mechanical fixing of the antenna onto a structure there is a need for the antenna to be fixed at the appropriate position and orientation to allow the transmitted signals to be received correctly. If the antenna is not properly fixed in position then the data may not be received at all or, more commonly, the data may be received but with an error rate that is so high that the audio or video which is subsequently processed is not of satisfactory quality.

The need to fix the antenna apparatus accurately is also problematic due to time pressures which the personnel fitting the apparatus may be under to fit the antenna quickly so as to meet set job tasks and performance targets. This can often mean that the antenna is not fitted as accurately as it could be. This problem is made worse by the fact that the existing adjustment means can be difficult to use, thereby making the continued adjustment of the same less attractive. The adjustment means typically comprise a threaded bolt connected to one of the mounting bracket or antenna which is tightened or untightened with respect to a threaded aperture to cause adjustment of position. In many cases, the adjustment means cannot be adjusted in a manner so as to allow sufficiently accurate or "fine" adjustment to be achieved. This can mean that the fitting tolerances for the antenna are required to be relatively wide so as to be achievable but this only allows a signal reception to be achieved which is satisfactory but not as good as it could be.

The aim of the present invention is to provide apparatus which allows the secure fitting of an antenna in position and also to allow the fine adjustment of the fitted antenna to be achieved in a manner which is accurate and practical to use.

In a first aspect of the invention there is provided mounting means for fixing antenna apparatus in a secured position, said mounting means including adjustment means to allow the user adjustment of the position of the item when mounted, said adjustment means including at least one rotatable member mounted to be rotatable about an axis offset to the centre axis of a body portion of the same such that, when rotated, adjustment of the position of the apparatus is achieved.

In one embodiment a rotatable member and shaped aperture is provided to allow adjustment of the azimuth and a separate rotatable member and shaped aperture is provided so as to allow adjustment of the elevation of the antenna apparatus.

In one embodiment the item which is mounted is antenna apparatus for the reception of broadcast digital data. Typically the antenna is in the form of a reflector and may be dish shaped. In one embodiment the item is for use in the reception of broadcast digital data and the transmission of digital data. When transmitting data the correct location of the antenna is particularly important so as to minimise interference issues with respect to regulations such as ETSI and/or the requirements of the satellite operators to whom the data is typically transmitted.

In one embodiment the transmission is at a high frequency (Ka) band in which fine adjustment is particularly important.

In one embodiment other data receiving apparatus such as a Low Noise Block and/or Block up converter is mounted in conjunction with the antenna.

In one embodiment the rotatable member is provided with a head portion for reception of a tool or is provided with a handle or lever via which the rotatable member can be rotated and a body member depending to the rear of the head. The body portion has side faces in contact with the walls of an aperture through which the rotatable member passes. The rotatable member also includes a threaded shaft which has a longitudinal axis in line with the axis of rotation of the head.

The rotatable member passes through the aperture in a first part of the bracket and the free end of the member is threaded so as to engage in a threaded aperture such as that provided in a nut, the nut serving to maintain the member in position as it is rotated such that rotation of the rotatable member causes contact with the sidewalls of the body member and the side walls of an aperture in one of the said parts and, as the axis of rotation is offset to the centre axis of the body portion, so relative movement of the said first and second parts and hence allows the elevation or azimuth adjustment to be made. The side walls of the body portion are therefore of a depth to allow the same to contact with the side walls of one of the apertures rather than both such that the relative movement of one part with respect to the other can be achieved in a controlled manner to achieve the fine adjustment when the rotatable member is moved.

Typically the item is mounted on the said second part of the bracket such that the item is movable in conjunction with the second part with respect to the first part.

In one embodiment the mounting apparatus includes a further clamping means arranged such that when the elevation and/or azimuth adjustment has been made using the invention, the further clamping apparatus can be used to "lock" the mounting apparatus in that position.

In a further aspect of the invention there is provided apparatus for mounting an antenna in a secured position, said apparatus including, a mounting bracket having a mounting base from which a first part depends and, in turn a second part depends from the first part, said antenna mounted to the second part, adjustment means are provided to allow either, or both of, adjustment of the elevation of the antenna via the first and second parts and/or adjustment of the azimuth of the antenna via the first part and the mounting base, and wherein at least one of the adjustment means includes a rotatable member passing through an aperture wherein the said rotatable member includes a shaft which passes from a body portion and which has an axis about which the member is rotated, said axis offset from the centre axis of the body portion.

In one embodiment the side walls of the body act as a cam with respect to said first aperture and cause movement between the first and second parts to cause adjustment of the elevation or movement between the first part and mounting base to cause adjustment of the azimuth or elevation, if fitted thereto.

Typically an adjustment means in accordance with the invention is provided for each of the azimuth and elevation adjustments.

Typically the adjustment means described herein are provided so as to allow the fine adjustment of the positions. In practice the user will typically adjust the mounting apparatus to the required position and secure the same and then allow the fine adjustment using the adjustment means as herein described.

In a yet further aspect of the invention there is provided a method of mounting an antenna of broadcast data receiving apparatus in a secured position, said apparatus including a mounting bracket, said method comprising the steps of securing the mounting bracket base onto a fixed support, supporting on said bracket, a first part, supporting a second part on said first part, securing the antenna to the second part, adjusting the first and second parts to a selected orientation, adjusting the first part and the mounting base to a required orientation, checking the azimuth and elevation positions of the antenna in comparison with predetermined values and, wherein if required, operating adjustment means provided to allow the fine adjustment of the azimuth and/or elevation position of the antenna to meet the predetermined values.

In one embodiment the fine adjustment is achieved by adjustment of a rotatable member.

In one embodiment the fine adjustment of the elevation is within the range of 6 degrees. In one embodiment the range of fine adjustment is between 7 and 13 degrees. In another embodiment the range of adjustment is between 57 and 63 degrees.

In one embodiment the fine adjustment of the azimuth is within the range of 6 degrees, typically between −3 and +3 degrees.

In a further aspect of the invention there is provided a mounting means for fixing an item in a secured position, said mounting means including adjustment means to allow the user adjustment of the position of the item when mounted, said adjustment means including at least one rotatable member mounted to be rotatable about an axis offset to the centre axis of the same such that, when rotated, adjustment of the position of the item is achieved.

Specific embodiments of the invention are now described with respect to the accompanying drawings wherein;

FIGS. 1*a*-3*b* illustrate a first range of fine adjustment of the elevation of the antenna apparatus achieved in accordance with the invention;

FIGS. 4*a*-6*b* illustrate a second range of fine adjustment of the elevation of the antenna apparatus achieved in accordance with the invention; and FIGS. 7*a*-9*b* illustrate a range of fine adjustment of the azimuth of an antenna apparatus in accordance with another embodiment of the invention.

Figure 2A:
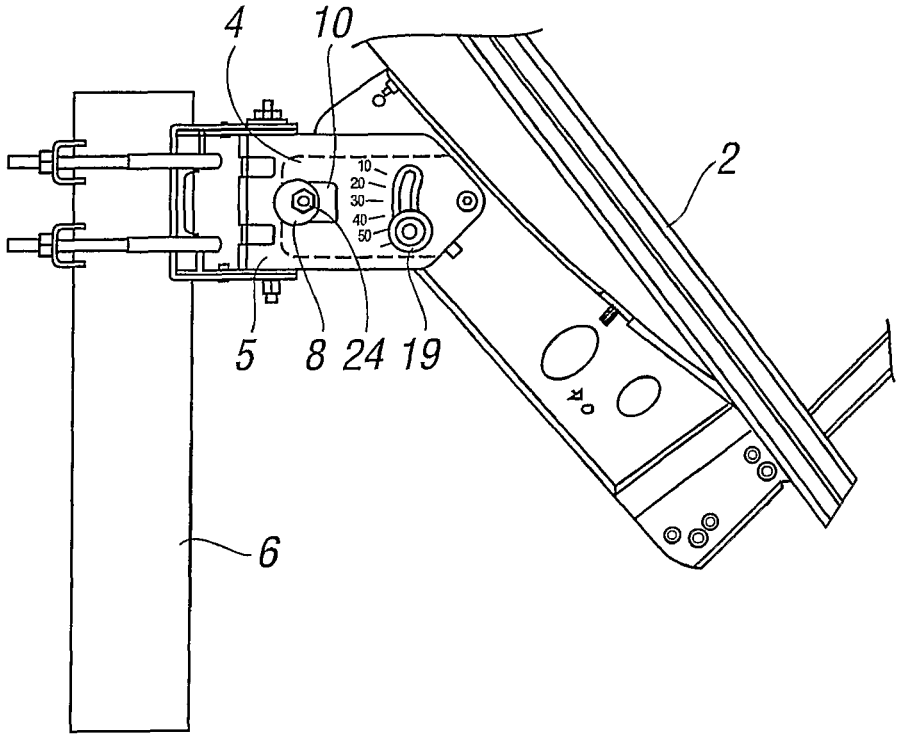
Figure 2B:
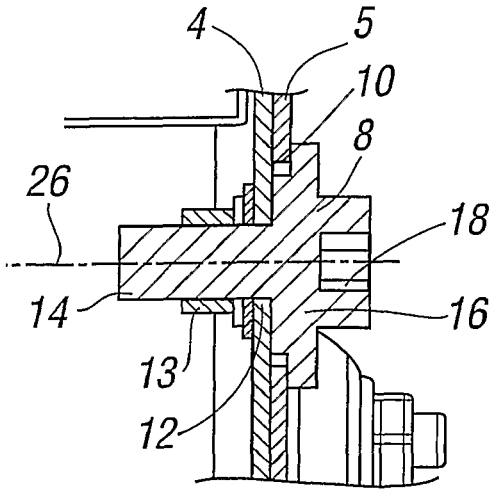
Figure 3A:
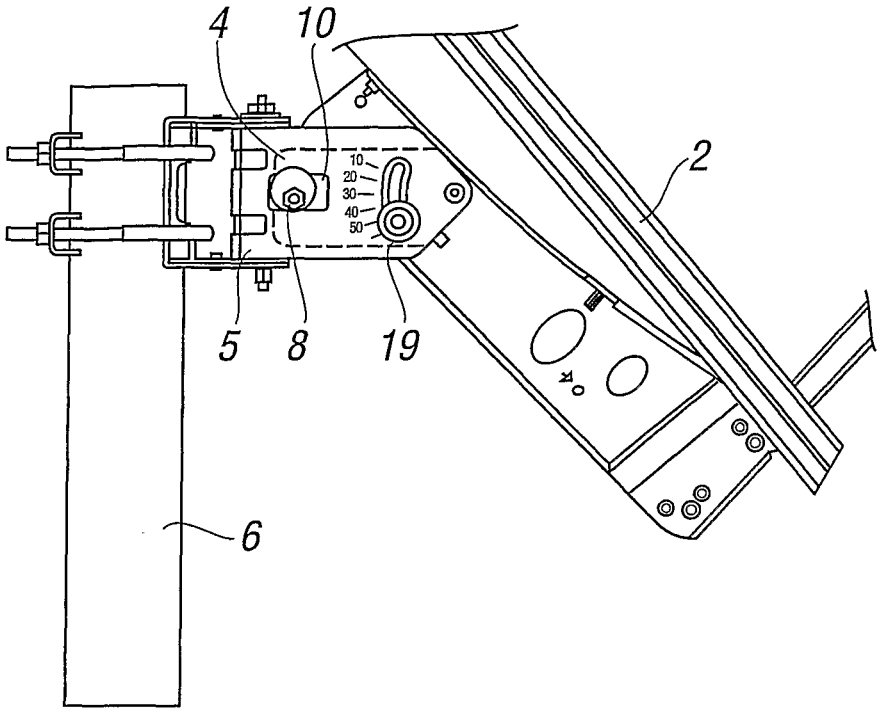
Figure 3B:
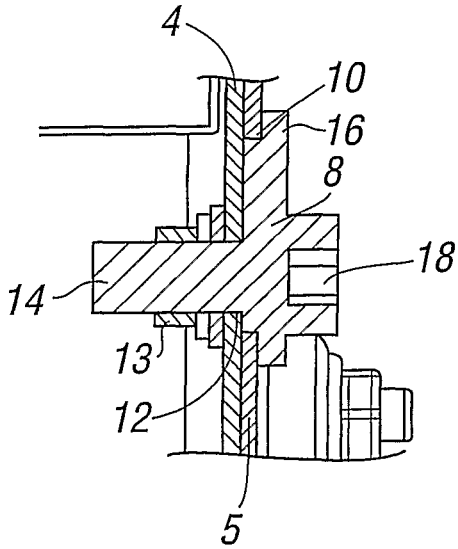
Figure 4A:
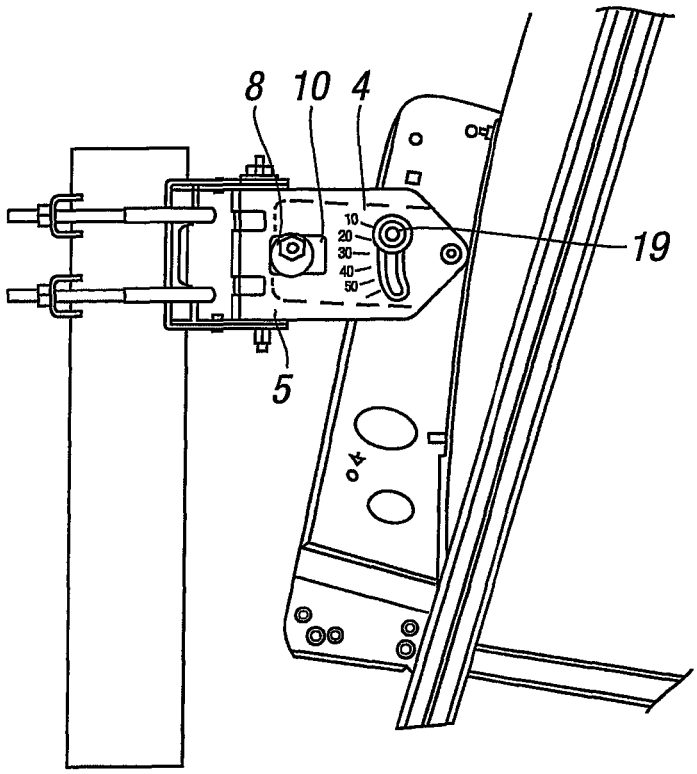
Figure 4B:
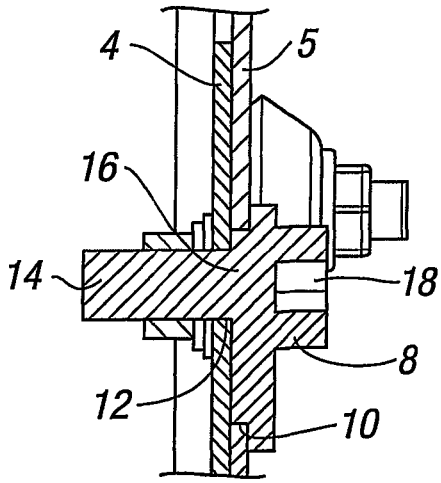
Figure 5A:
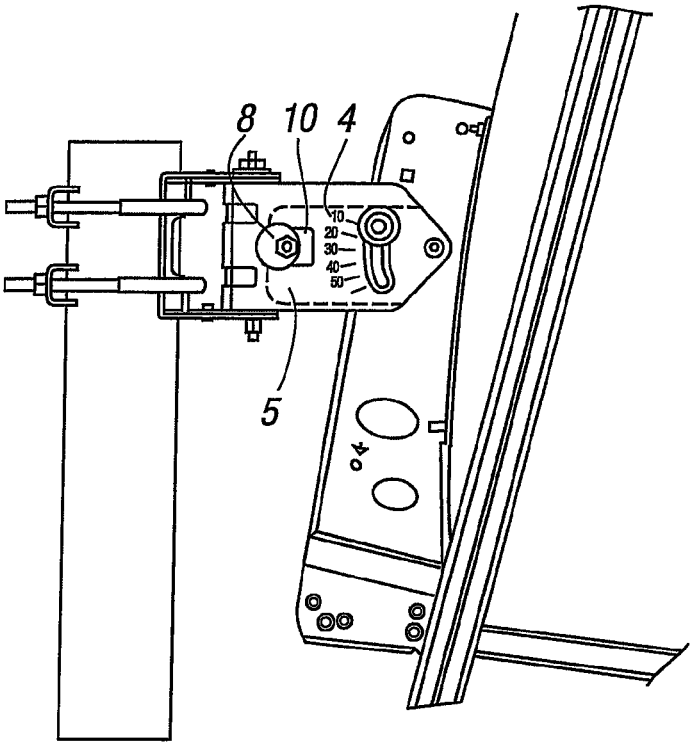
Figure 5B:
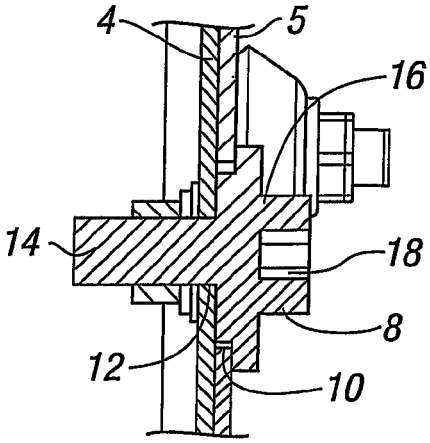
Figure 6A:
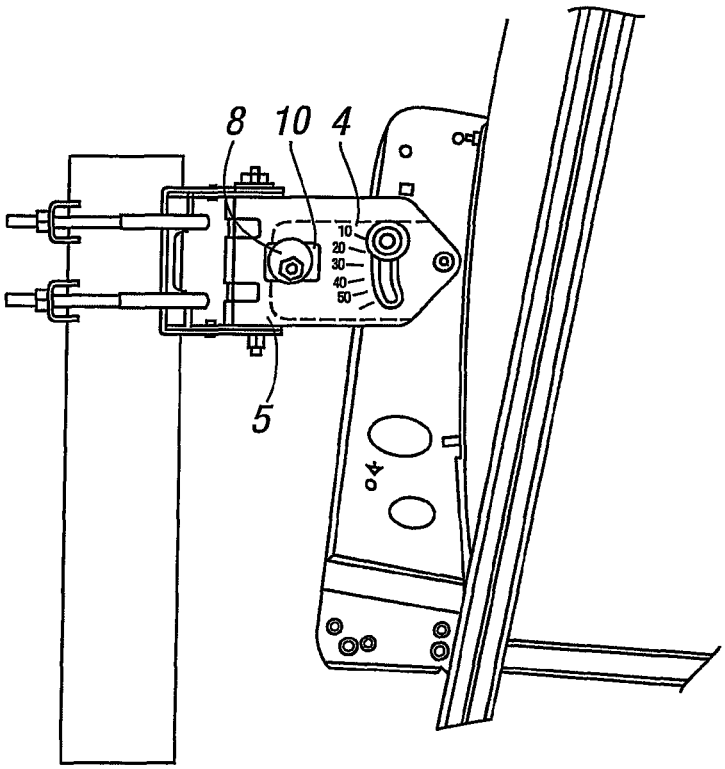
Figure 6B:
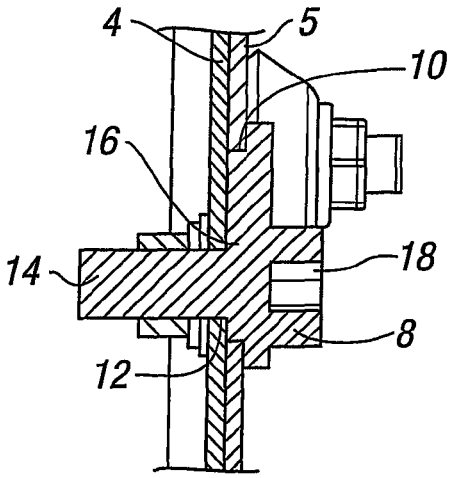
Figure 7A:
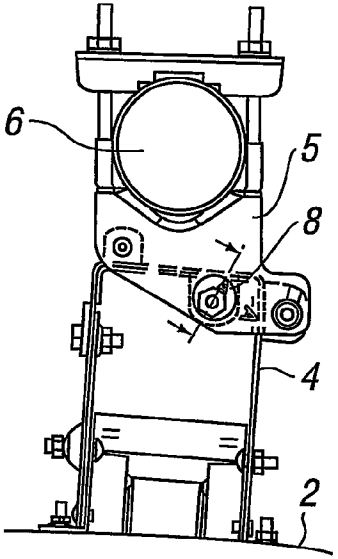
Figure 7B:
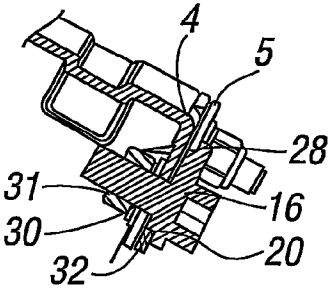
Figure 8A:
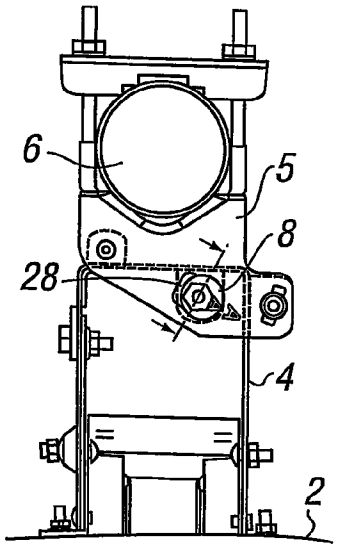
Figure 8B:
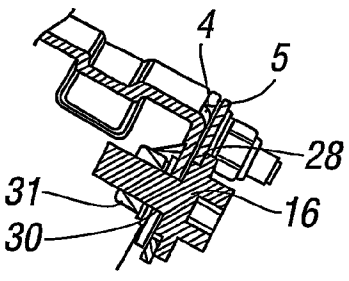
Figure 9A:
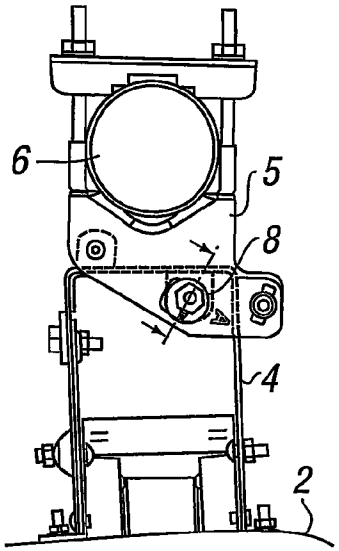
Figure 9B:
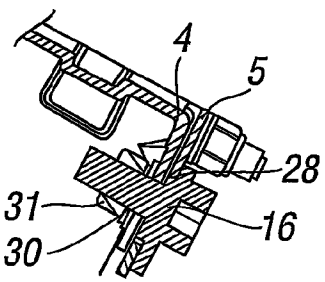

Referring firstly to FIGS. 1*a*, 2*a*, 3*a* there is illustrated part of an antenna 2 which is mounted on a mounting bracket. The antenna is attached to a second part 4 of the mounting bracket which in turn is attached to a first part 5 which is then in turn mounted on the main bracket 6 which is in turn attached to a secure fixture such as the wall of a building.

The first and second parts of the mounting bracket can initially be secured together to allow the antenna to be mechanically fixed in position and this can be achieved in a conventional manner. However there is often a need to allow fine adjustment of the antenna 2 position with respect to the mounting bracket so that the most efficient reception of transmitted data signals can be achieved as well as, in certain instances, the transmission of data to be accurately achieved.

In accordance with the invention as shown in FIGS. 1*a*-6*b* the adjustment of the elevation of the antenna is achieved by the selective rotation of a rotatable member 8. The rotatable member passes through an aperture 10 in the first part 5 and into an aperture 12 in the second part 4 and then to a securing nut 13. The nut 13 is threaded and receives the threaded shaft 14 of the rotatable member. The shaft 14 is connected to a body portion 16 of the rotatable member and in turn to a head portion 18. The body portion includes a side wall 20 as shown in FIG. 1*b* which contacts with the side walls 22 of the aperture 10 and acts as a cam.

The head portion includes a formation 24 for engagement of a tool, or in another embodiment, a handle may be provided, to allow the rotatable member to be rotated about the longitudinal axis 26 of the shaft which is offset to the centre of the body portion 16.

In FIGS. 1*a*-3*b* it is shown how the selective rotation of the rotatable member allows the elevation angle to be adjusted through 6 degrees between 57 and 63 degrees of elevation and how the adjustment causes movement of the second part and antenna, with respect to the first part to alter the angle of the same.

In FIGS. 4*a*-6*b* there is shown the same fine adjustment through 6 degrees but in this example the fine adjustment is between 7 and 13 degrees.

In whichever embodiment further clamping means 19 may be provided. These further clamping means can be utilised once the fine adjustment has been made to effectively lock the position of the antenna and prevent slippage of the position during subsequent use of the same.

In addition, or alternatively, a further rotatable member can be provided, in this case to allow adjustment of the azimuth position and this is illustrated in FIGS. 7*a*-9*b*. In this case a rotatable member 8 passes through an aperture 28 in the first part 5 of the mounting bracket and into an aperture 30 in the mounting base 4 and then a nut 31. The principal of operation is the same in that rotation of the member 8 causes the body portion 16 of the same and in particular the side walls 20 of the same to act on side wall 32 of the aperture 28 to act as a cam as the same is rotated and hence move the part 5 with respect to the base 4 and thereby allow fine adjustment of the azimuth position between −3 degrees and +3 degrees as shown in FIGS. 7*a*-9*b*.

In accordance with the invention there is therefore provided a mounting bracket which allows the fine adjustment of an antenna with respect to a secure mounting so as to allow the most efficient and accurate reception of transmitted data. Furthermore, the adjustment can be achieved in an accurate manner and can be achieved by the person fitting the antenna in position subsequently using the one or more rotatable members in accordance with the invention without unduly prolonging the time required for the overall fitting operation to be performed.

The invention claimed is:

1. A mounting means for fixing antenna apparatus in a secured position, said mounting means comprising:

a first bracket part and a second bracket part;

adjustment means to allow relative adjustment between the position of the first bracket part and the second bracket part, said adjustment means including a shaped aperture in the first part, and an aperture in the second bracket part;

at least one rotatable member passing through said shaped aperture in the first part and through the aperture in the second part, wherein said rotatable member includes a head portion with a body portion to the rear of the head portion and a threaded shaft with a longitudinal axis in line with an axis of rotation of the head portion, and the body portion including a side wall of a depth to contact with side walls defining said shaped aperture in said first bracket part to act as a cam but not in contact with the side walls defining the aperture in the second bracket part and said rotatable member is rotatable about said longitudinal axis which is offset to the center axis of the body portion such that, when rotated, adjustment of the azimuth position of the apparatus is achieved.

2. The mounting means according to claim 1 wherein the mounting means is provided as part of the antenna apparatus for use in the reception of broadcast digital data and/or the transmission of digital data.

3. The mounting means according to claim 1 wherein the head portion for reception of a tool via which the rotatable member can be rotated, and the body portion.

4. The mounting means according to claim 1 wherein the antenna apparatus to be adjusted positionally item is mounted on the said second part of the bracket such that the apparatus is movable in conjunction with the second part.

5. The mounting means according to claim 1 wherein further clamping means are provided, said clamping means used to lock the mounting means in position once adjustment of the azimuth has been performed.

6. The apparatus according to claim 1 wherein the rotation of the adjustment means causes the side walls of the body to act as a can with respect to said first aperture and cause movement between the first and second parts to cause adjustment of the elevation, or movement between the first part and mounting base to cause adjustment of the azimuth.

7. The apparatus according to claim 6 wherein adjustment means are provided for each of the azimuth and elevator adjustments.

8. Apparatus for mounting an antenna in a secured position, said apparatus comprising:

a mounting bracket having a mounting base from which a first bracket part depends and, in turn a second bracket part depends from the first part, said antenna mounted to the second part, adjustment means to allow either, or both of, adjustment of the elevation of the antenna via the first and second parts and/or adjustment of the azimuth of the antenna via the first part and the mounting base, and wherein at least one of the adjustment means includes a rotatable member passing through a shaped aperture in said first part wherein the said rotatable member includes a shaft which passes from a body portion and which has a longitudinal axis about which the rotatable member is rotated, said axis offset from a center axis of the body portion and wherein the body portion has a side wall in contact with said aperture to cause relative movement of the elevation or azimuth position as the rotatable member is rotated.

9. The apparatus according to claim 8 wherein the member passes through an aperture and in contact into a nut with the free end of the shaft received therein to secure the member with respect to the first and second parts.

10. The apparatus according to claim 9 wherein adjustment means are provided for each of the azimuth and elevation adjustments.

11. Mounting means for fixing an item in a secured position, said mounting means comprising:

adjustment means to allow the user adjustment of the position of a first bracket part having a shaped aperture and a second bracket part having an aperture when mounted, said adjustment means including at least one rotatable member mounted to be rotatable about an axis offset to the center axis of a body portion of the same such that when rotated, adjustment of the position of the first part of the item is achieved by contact between a side wall of the body portion of the rotatable member and an aperture in an antenna apparatus with which the side wail of the body portion contacts as the rotatable member is rotated.

12. A method of mounting an antenna of broadcast data receiving apparatus in a secured position, said apparatus including a mounting bracket, said method comprising the steps of:

securing the mounting bracket base onto a fixed support, supporting on said bracket a first part having a shaped aperture, supporting a second part having an aperture, securing the antenna to the second part, adjusting the first and second parts to the selected orientation, adjusting the first part and the mounting base to a required orientation, checking the azimuth and elevation positions of the antenna in comparison with predetermined values and, wherein if required, operating adjustment means provided to allow the fine adjustment of the azimuth and/or elevation position of the antenna to meet the predetermined values, said fine adjustment achieved by operating a rotatable member passing through said shaped aperture of said first part about an axis offset to the center axis of the body portion of the rotatable member.

13. A method according to claim 12 wherein the fine adjustment of the elevation and/or azimuth is within a range of 6 degrees.

* * * * *